US010508814B2

(12) United States Patent
Wu

(10) Patent No.: US 10,508,814 B2
(45) Date of Patent: Dec. 17, 2019

(54) BIOMASS PELLET STOVE

(71) Applicants: QSTOVES INC., Bellevue, WA (US); Qingdao Genjoy Home Fashion Co., Ltd., Qingdao, Shandong (CN)

(72) Inventor: Xiaohui Wu, Bellevue, WA (US)

(73) Assignees: QSTOVES INC., Bellevue, WA (US); Qingdao Genjoy Home Fashion Co., Ltd., Qingdao, Shandong (CN)

( * ) Notice: Subject to any disclaimer, the term of this patent is extended or adjusted under 35 U.S.C. 154(b) by 360 days.

(21) Appl. No.: 15/465,274

(22) Filed: Mar. 21, 2017

(65) Prior Publication Data

US 2017/0328572 A1 Nov. 16, 2017

Related U.S. Application Data

(63) Continuation-in-part of application No. 15/151,725, filed on May 11, 2016.

(51) Int. Cl.
*F24B 13/04* (2006.01)

(52) U.S. Cl.
CPC ..... *F24B 13/04* (2013.01)

(58) Field of Classification Search
CPC ..... F24B 13/04; F24B 1/024; F23B 50/12
USPC ..... 110/293; 126/73
See application file for complete search history.

(56) References Cited

U.S. PATENT DOCUMENTS 2,380,000 A * 7/1945 Walton ..... 126/146
4,416,248 A * 11/1983 Schlosser ..... A47J 37/0786 126/182
5,144,939 A * 9/1992 Christopherson ..... A01G 13/06 110/108
6,397,833 B1 * 6/2002 Jarvi ..... F23B 1/38 110/214
8,020,547 B2 * 9/2011 Hepper ..... F24B 1/024 110/233
2002/0083944 A1 * 7/2002 Darbonne, Sr. ..... F23B 1/38 126/501
2016/0161127 A1 * 6/2016 Hill ..... F24B 13/04 126/73

* cited by examiner

*Primary Examiner* — Avinash A Savani
*Assistant Examiner* — Aaron H Heyamoto
(74) *Attorney, Agent, or Firm* — Young Basile Hanlon & MacFarlane, P.C.

(57) ABSTRACT

A stove, using biomass pellets as fuels, includes: a stove body that includes a firebox; at least one hopper; and at least one feed tube extending between the at least one hopper and the firebox; and at least one control lever laterally disposed on the at least one feed tube; wherein, fuels within the at least one hopper enter the firebox along the at least one feed tube under gravity when the at least one control lever is in a second position.

18 Claims, 18 Drawing Sheets

Section A-A

Section A-A

BIOMASS PELLET STOVE

CROSS-REFERENCE TO RELATED APPLICATION(S)

This application claims priority to U.S. patent application Ser. No. 15/151,725 filed May 11, 2016, and hereby incorporates by reference the application in its entirety.

TECHNICAL FIELD

The present disclosure relates to the technical field of pellet stoves, and in particular to a pellet stove that uses biomass pellets as fuels.

BACKGROUND

Pellet stoves that use biomass pellets as fuels can have a large size and heavy weight, inconvenient for mobile use after installing, and are usually suitable for indoor use. In addition, they often have complex designs and high manufacturing cost, and may include many electrical components, such as an auger system and/or other feeding apparatuses to feed biomass pellets to a firebox, which may limit reliability and/or raise costs of use and/or maintenance.

For activities such as outdoor travelling, camping, hiking, leisure activities, in a low temperature, people often resort to relatively primitive means, such as a campfire or a fire pit with burning woods, for heating and warming.

SUMMARY

Disclosed herein are aspects, features, elements, implementations, and embodiments of a stove that uses biomass pellets as fuels.

An aspect of the disclosed embodiments is a stove, using biomass pellets as fuels, that includes: a stove body that includes a firebox; at least one hopper; and at least one feed tube extending between the at least one hopper and the firebox; and at least one control lever laterally disposed on the at least one feed tube; wherein, fuels within the at least one hopper enter the firebox along the at least one feed tube under gravity when the at least one control lever is in a second position.

Another aspect of the disclosed embodiments is a stove, using biomass pellets as fuels, that includes: a stove body that includes a firebox; a first hopper disposed on a first side of the stove and a second hopper disposed on a second side of the stove; and a first feed tube extending between the first hopper and the firebox and a second feed tube extending between the second hopper and the firebox; and a first control lever laterally disposed on the first feed tube and a second control lever laterally disposed on the second feed tube; wherein, fuels within the first hopper enter the firebox along the first feed tube under gravity when the first control lever is in a second position and wherein fuels within the second hopper enter the firebox along the second feed tube under gravity when the second control lever is in the second position.

Variations in these and other aspects, features, elements, implementations, and embodiments of the methods, apparatus, procedures, and algorithms disclosed herein are described in further detail hereafter.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The foregoing descriptions are merely preferred embodiments or implementations rather than limitations of the present disclosure. Various modifications and alterations can be made to the present disclosure for those skilled in the art. Any modification, equivalent substitution, improvement or the like made within the spirit and principle of the present disclosure shall fall into the protection scope of the present disclosure.

Pellet stoves that use biomass pellets as fuels can have a large size and heavy weight, inconvenient for mobile use after installing, and are usually suitable for indoor use. In addition, they often have complex designs and high manufacturing cost, and may include many electrical components, such as an auger system and/or other feeding apparatuses to feed biomass pellets to a firebox, which may limit reliability and/or raise costs of use and/or maintenance.

For activities such as outdoor travelling, camping, hiking, leisure activities, in a low temperature, people often resort to relatively primitive means, such as a campfire or a fire pit with burning woods, for heating and warming. Accordingly, a portable biomass pellet stove may be desirable.

Figure 1:
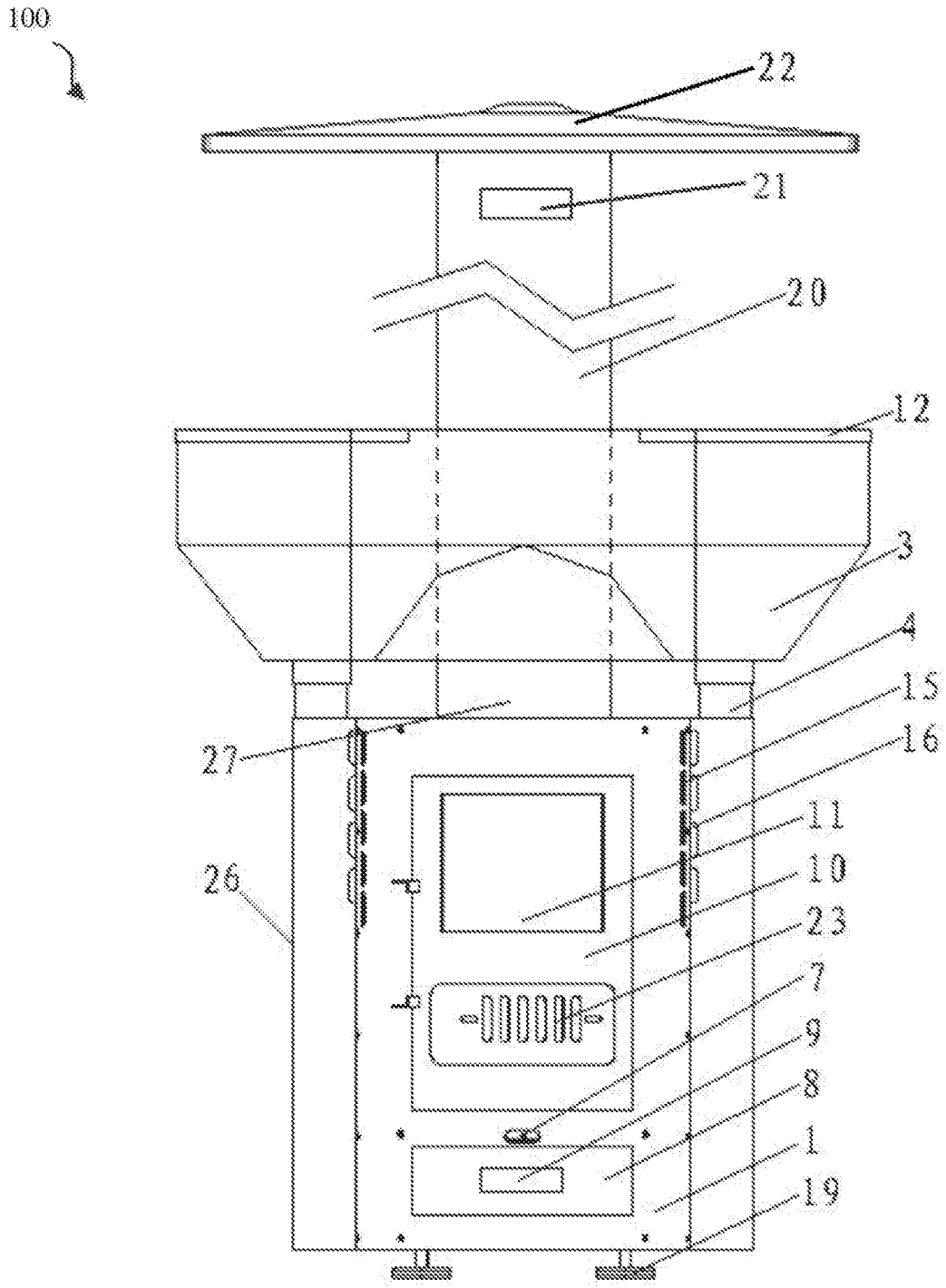
FIG. 1 generally illustrates an example biomass pellet stove according to the principles of the present disclosure.
Figure 2:
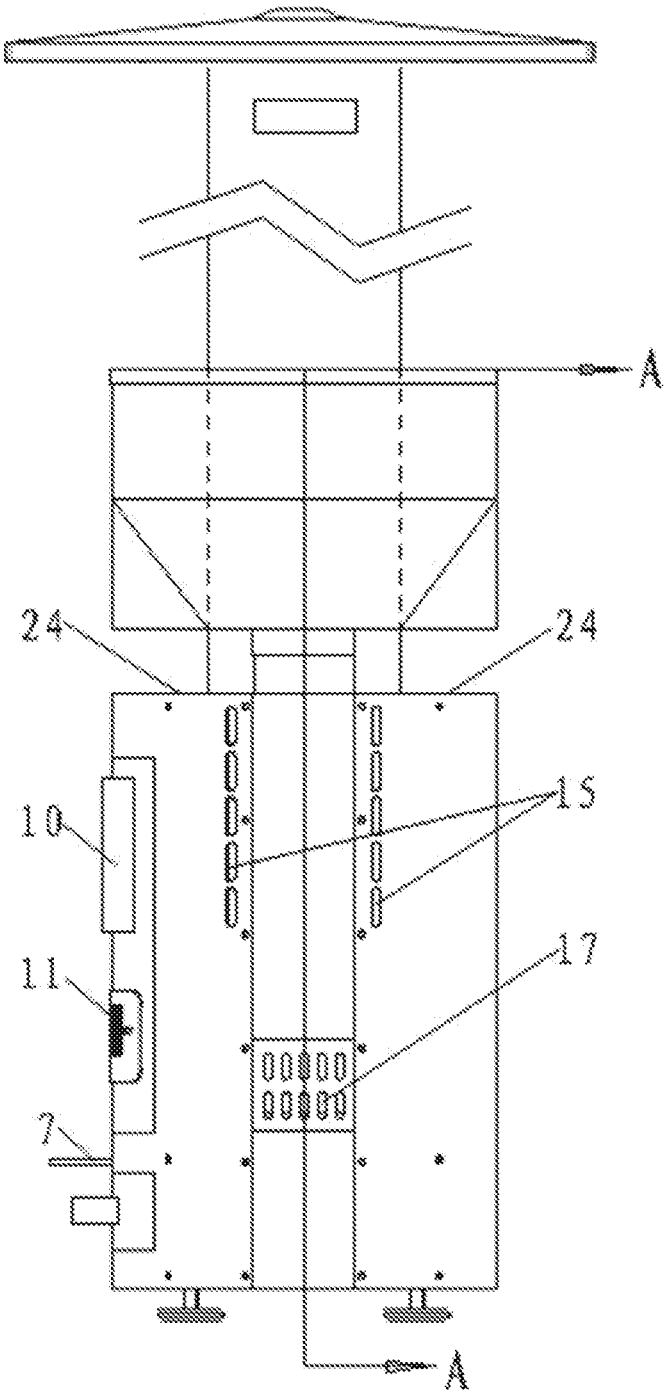
FIG. 2 generally illustrates an example biomass pellet stove according to the principles of the present disclosure.

FIGS. 1 and 2 generally illustrate an example biomass pellet stove 100 according to the principles of the present disclosure. The stove 100 includes a stove body 1. The stove body 1 includes a firebox 2, which a firebox 2 resides and/or is disposed within a portion of the stove body 1, and one or more hoppers 3. In some embodiments, the stove body 1 includes two hoppers 3. The hoppers 3 are installed and/or disposed symmetrically relative to each other. Each of the hoppers 3 are connected to the firebox 2 via one of two symmetrically disposed feed tubes 4. Fuels, such as biomass pellets, may be loaded and/or inserted into at least one of the one or more hoppers 3. The biomass pellets loaded and/or inserted into each of the hoppers 3 may enter the firebox 2 via the feed tubes 4 under gravity.

The stove 100 may comprise a relatively simple structure and removes any mechanically and/or electrically controlled feeding system by feeding the firebox 2 using gravity of the biomass pellets. This may, for example, lowers use, operating, and/or maintenance the costs associated with the stove 100. In an embodiment of the stove 100 that includes two hoppers 3, storage capacity of fuels, such as biomass pellets, may be increased over similar embodiments including less hoppers 3. By including two hoppers 3, combustion time. In some embodiments, the hoppers 3 are installed symmetrically, relative to each other, such that, that the biomass pellets are fed into the firebox 2 from both sides evenly or substantially evenly, which may make the combustion more stable and/or balanced.

In some embodiments, the hoppers 3 are arranged and/or disposed at or near an upper portion of the stove body 1. Each hopper includes a gap between the stove body 1 and a respective hopper cover 12. Each of the hopper covers 12 is disposed at or near a top portion of a respective hopper 3. The gaps between the hoppers 3 and the stove body 1 may serve as an air insulation to avoid overheating of the hoppers 3, which effectively controls temperature of the fuels loaded and/or inserted into the hoppers 3. This may improve safety features of the stove 100 by preventing the hoppers 3 from overheating and becoming a potential burn hazard for users of the stove 100. Additionally, or alternatively, gaps between the hoppers 3 and the stove body 1 may provide a baking area 24 that provides means to bake, warm, keep warm, or a combination thereof, food above stove body 1. The hopper covers 12 may reduce an amount of air that can enter respective hoppers 3. By reducing the amount of air that can enter the hoppers 3, a potential for the biomass pellets loaded and/or inserted in each of the hoppers 3 may be reduced and/or eliminated.

Figure 3:
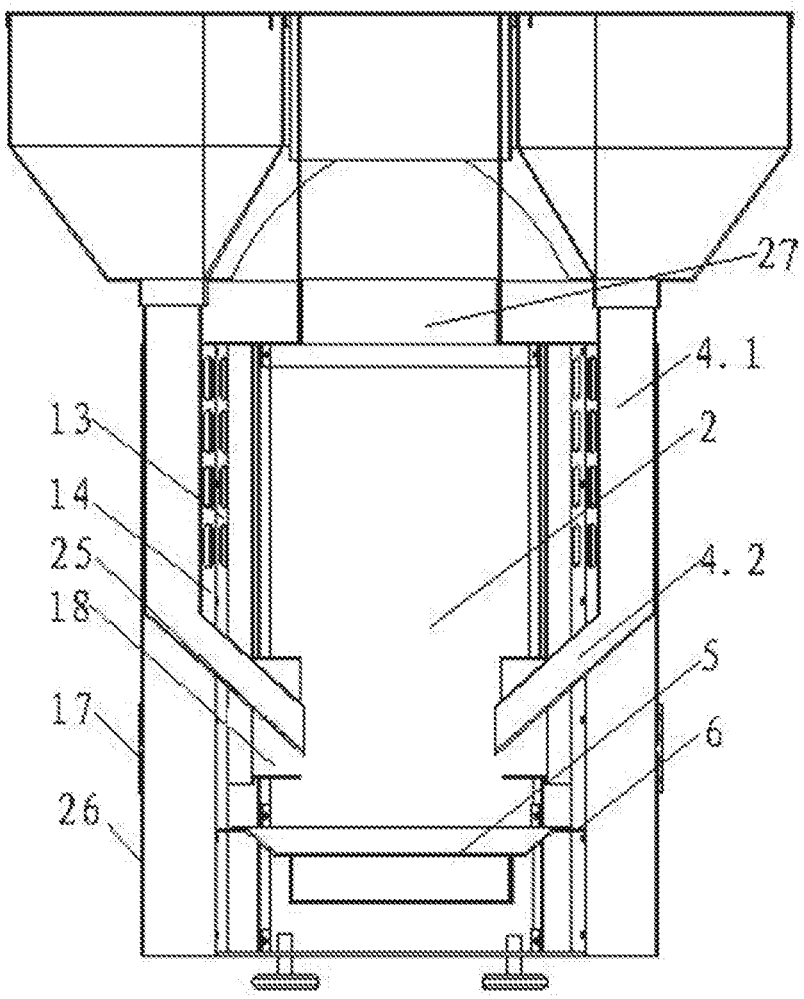
FIG. 3 generally illustrates a section A-A of the example biomass pellet stove generally illustrated in FIG. 2.

Each of the feed tubes 4 may include an upright tube 4.1 and a slant tube 4.2 as is generally illustrated in FIG. 3. Each slant tube 4.2 is disposed at or near a bottom portion of a respective upright tube 4.1, Fuels, such as biomass pellets, loaded and/or inserted into respective hoppers 3, pass through the upright tubes 4.1 into respective slant tubes 4.2 That is, an upright tube 4.1 is joined to a respective hopper 3 via a respective slant tube 4.2. In some embodiments, a first end portion of an upright tube 4.1 includes an aperture that opens into a bottom of a respective hopper 3 and a second end portion of the upright tube 4.1, disposed on opposite the first end portion of the upright tube 4.1, joins and/or connects the upright tube 4.1 to a third end portion of a respective slant tube 4.2. A fourth end portion of the slant tube 4.2, disposed opposite the third end portion of the slant tube 4.2, includes an aperture that opens into the firebox 2. Fuels, such as biomass pellets, may pass through the aperture associated with the fourth end portion of the slant tube 4.2 into the firebox 2. Each upright tube 4.1 may utilize gravity in order to draw the fuels down through each upright tube 4.1, through respective slant tubes 4.2, for feeding the fuels into the firebox 2. The dimensions of each upright tube 4.1 and each slant tube 4.2 may provide a, means for reducing an amount of time the fuels are inside the upright tubes 4.1 and the slant tubes 4.2.

On each side of the stove body 1, a casing 26 may be fixedly secured to a portion of the stove body 1. Each upright tube 4.1 is disposed within a respective casing 26. An interlayer I 13 is arranged and/or disposed between the casing 26 and the stove body 1. The interlayer I 13 connects to ambient air with a vent I 15. An interlayer II 14 is arranged and/or disposed between the casing 26 and the upright tube 4.1. The interlayer II 14 connects to ambient air with a vent II 16. By setting up the interlayer I 13 and the interlayer II 14, based on air insulation, the fuels within in the upright tube 4.1 can avoid contact with the stove body 1 in a long time and a close distance, which prevents the fuels inside the upright tube 4.1 from overheating and/or combusting.

The firebox 2 may be coupled with an air intake pipe 18, inside which the fourth end portion of the slant tube 4.2 can be disposed. The vent III 17 can be arranged and/or disposed on an outside surface of the casing 26, with which the air intake pipe 18 connects to ambient air. The fourth end portion of the slant tube 4.2 can be arranged as enclosed within the air intake pipe 18, pointing in a direction along incoming air (an inward wind), therefore simultaneously raises combustion efficiency and unblocks the fuel feeding.

A cross section of the firebox 2 comprises a circular shape, which can permit fire within the firebox 2 to spiral easily, therefore the fuels can burn more thoroughly and the combustion efficiency can be improved.

The stove body 1 includes an exhaust 27 that connects to a chimney 20. In some embodiments, the connection between chimney 20 and exhaust 27 is fixed and/or detachable. A length of the chimney 20 is adjustable, which includes disposed at an upper portion a vent IV 21 that fits in a spark arrestor, and includes disposed at a top a dish-shaped chimney cap (heat reflector) 22. Due to chimney effects generated by the chimney 20, the chimney 20 can provide a natural draft that creates a pressure difference between the firebox 2 and ambient air around the stove 100, which supports combustion by the incoming air. The vent IV 21 disposed at the upper portion of chimney 20 can dissipate heat, and the spark arrestor fitted therein can prevent emissions of sparks. The chimney cap (heat reflector) 22 can comprise a dish shape and/or have profile similar to a profile of a dish, curving downwards, which converges uprising heat from the firebox 2. Heated air is then conducted and/or directed to a lower position, by which the heated air can diffuse around areas surrounding the stove body 1 below the chimney cap (heat reflector) 22 to improve warming effect. Additionally, or alternatively, the chimney cap (head reflector) 22 can provide aesthetic benefits.

The firebox 2 may include a grate 5. The grate 5 is disposed within the firebox 2, in which grate 5 is disposed lower than the connection between the feed tubes 4 and the firebox 2. With such an embodiment, the fuels above the grate 5 can burn into ashes that can later fall under the grate 5, by which the height of the fuels above the grate 5 can be lowered, further causing the fuels within the hoppers 3 to drop, under gravity, onto the grate 5 via the feed tubes 4, thus providing automatic control of feeding the fuels from the hoppers 3 into the firebox 2. The stove body 1 includes a grate support ring 6 disposed within the stove body 1, upon which the grate 5 can be placed.

Figure 6A:
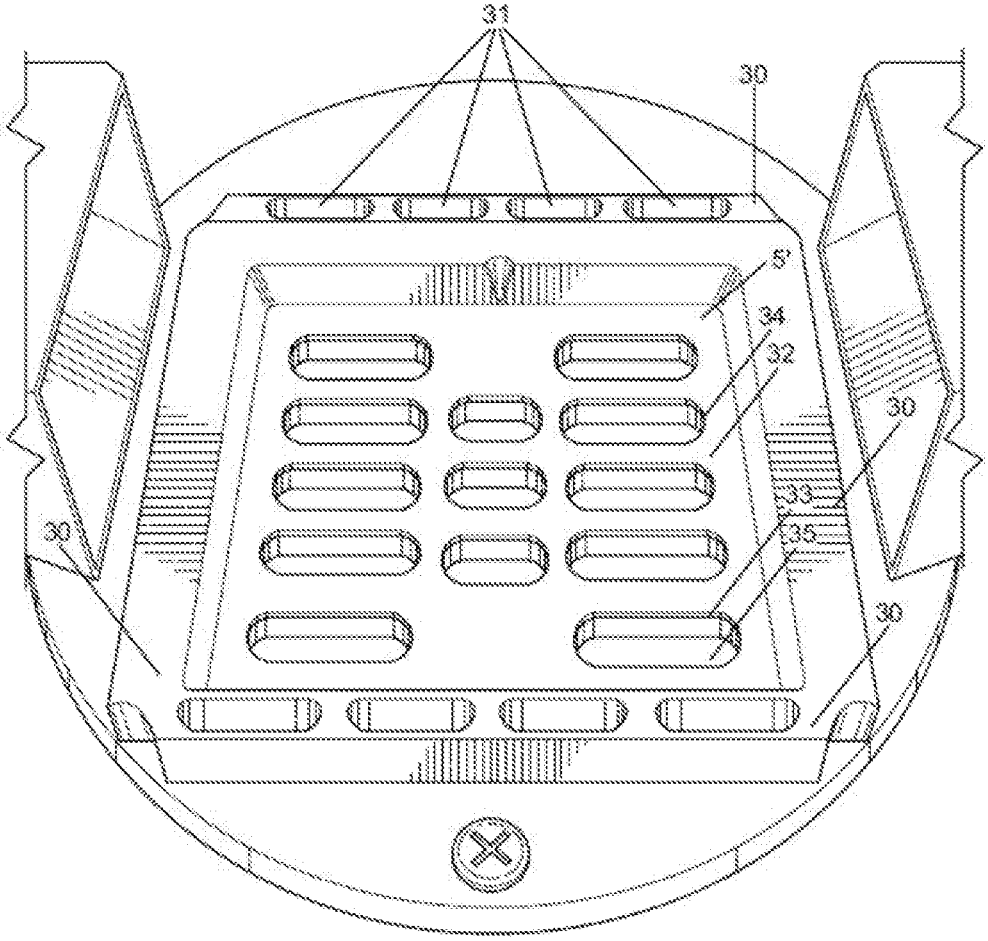
FIGS. 6A-6C generally illustrate an example grate according to the principles of the present disclosure.

In some embodiments, the firebox 2 can include a grate 5', as is generally illustrated in FIG. 6A. The grate 5' includes one or more side walls 30. Each side wall 30 extends along a perimeter of a corresponding side of the grate 5' and extends away from the grate 5' toward a top portion of the firebox 2. In some embodiments, the grate 5' includes four side walls 30, such that, the four side walls 30 form a pot or bowl shape. When the fuels, such as the biomass pellets, enter the firebox 2, the fuels fall in a concentrated pattern into the pot or bowl formed by the side walls 30. This may provide an increase in flame concentration.

In some embodiments, at least one of the side walls 30 includes a profile that is wide than a corresponding profile of another side wall 30. For example, the at least one side wall 30 may be twice as wide as the other side walls 30. The at least one side wall 30 includes a plurality of apertures 31 disposed along a length of the at least one side wall 30. The apertures 31 may be disposed evenly or unevenly along the length of the at least one side wall 30.

The at least one side wall 30 includes a plurality of holes disposed along a side of the at least one side wall 30 opposite the apertures 31. For example, the apertures 31 are disposed along a top of the at least one side wall 30 and the holes are disposed along a bottom of the at least one side wall 30. The holes may be evenly or unevenly distributed along the at least one side wall 30. In some embodiments, the apertures 31 substantially align with a corresponding hole on the at least one side wall 30. The apertures 31 and the holes may provide an increased air flow around the grate 5', increase ventilation, increase wind-ducting effect, increase fuel combustion, or a combination thereof, which may improve aerodynamic features of the grate 5' Additionally, or alternatively, because the grate 5' increases ventilation in and around the grate 5', an accumulation of ashes above the grate 5' is reduced, which can promote air flowing freely for a relatively longer period of time without external interference which may greatly extend the burning time of fuels within the firebox 2.

Figure 6B:
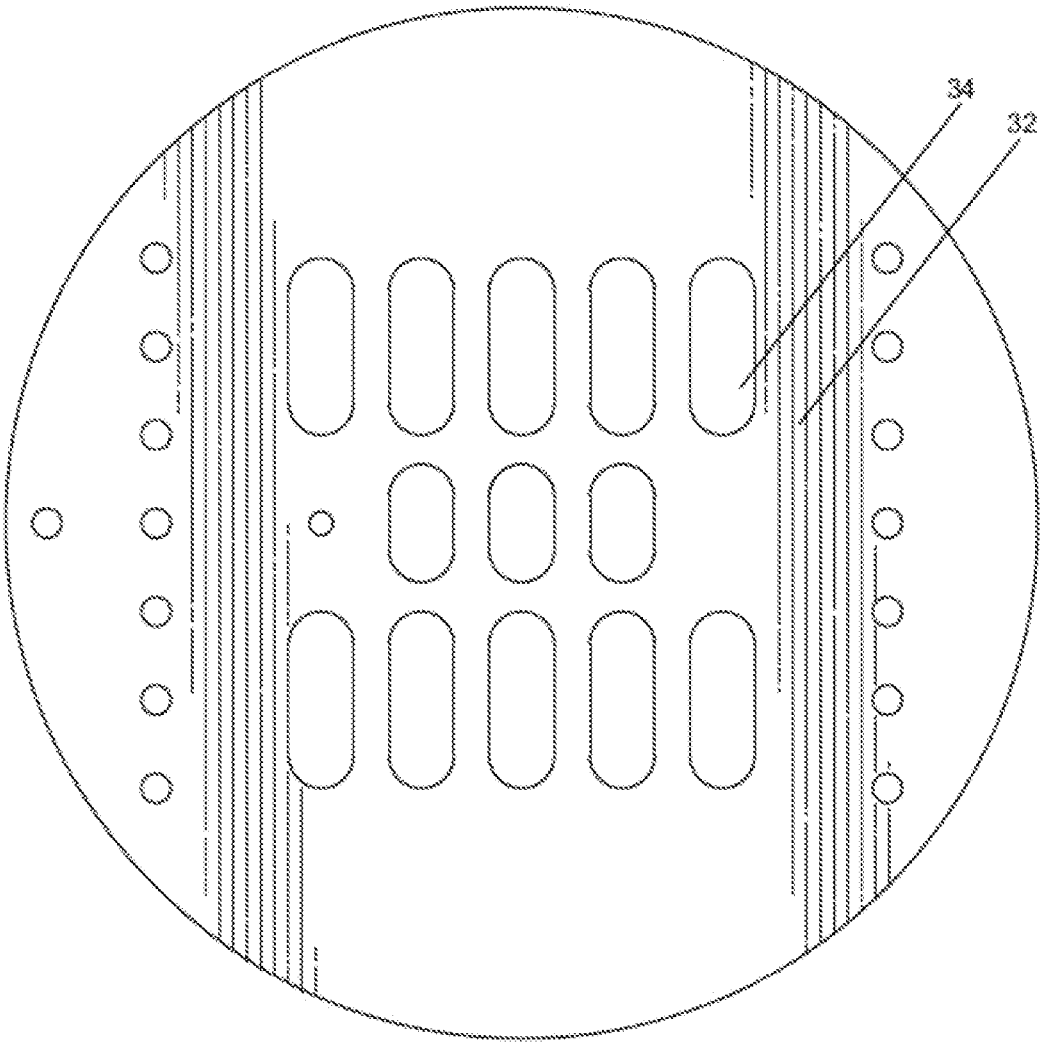
Figure 6C:
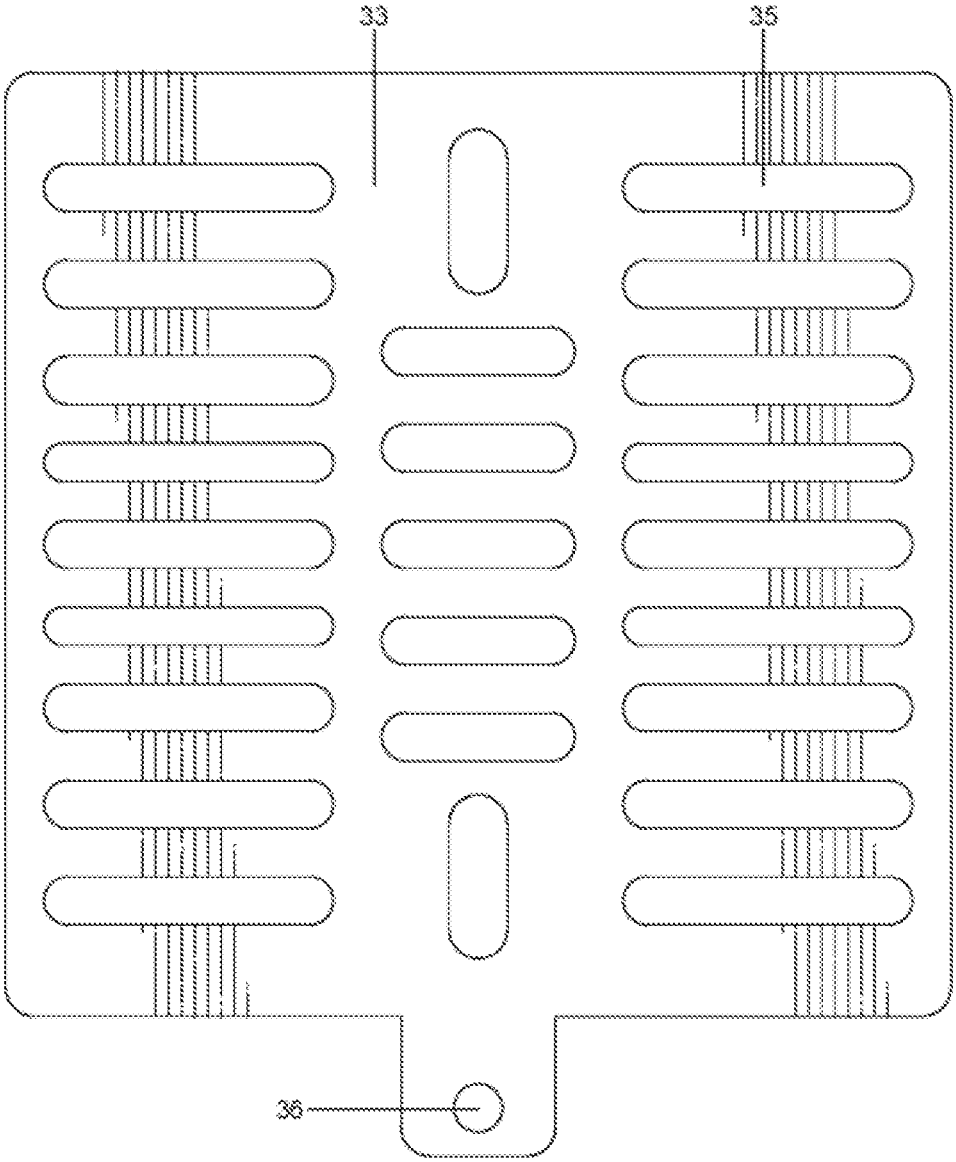

In some embodiments, the grate 5' includes a plate 32 and a shaker 33. The plate 32 is disposed on an upper portion of the grate 5' above the shaker 33. As is generally illustrated in FIG. 6B, the plate 32 includes a plurality of holes 34. As is generally illustrated in FIG. 6C, the shaker 33 includes a plurality of holes 35 disposed on the shaker 33. In some embodiments, the holes 35 are disposed on the shaker 33 in staggered pattern relative to the holes 34 of the plate 32. The shaker 33 includes an attachment portion 36. The attachment portion 36 may be attached, coupled, and/or connected to an end of the grate lever 7.

An ash tray 8 is arranged under the grate 5 and/or grate 5'. Ashes resulted from combustion of the fuels can fall from the grate 5 and/or grate 5' onto the ash tray 8. A grate lever 7 can be fixedly joined to the grate 5 and/or grate 5'. In some embodiments, the grate lever 7 can penetrate and extend outside the stove body 1. In some embodiments, by shaking the grate lever 7, the fire can be controlled, and the ashes can fall below the grate 5 into the ash tray 8.

In some embodiments, the grate lever 7 is fixedly joined to the grate 5'. The grate lever 7 can be actuated away from the firebox 2 (e.g., pulled out away from the firebox 2) and actuated toward the firebox 2 (e.g. pushed in toward the firebox 2). When the grate lever 7 is actuated toward the firebox 2, the shaker 33 is actuated to a first position. When the shaker 33 is in the first position, the holes 35 are in a first position relative to the holes 34. The holes 34 and the holes 35 define a through bore pass through the plate 32 and the shaker 33. When the shaker 33 is in the second position, the holes 35 are in a second position relative to the holes 34. The through bore defined by the holes 34 and the holes 35 may increase or decrease in size as the shaker 33 is actuated from the first position to the second position. In some embodiments, actuating the grate lever 7 from the first position to the second position may cause ashes to pass through the through bore defined by the holes 34 and the holes 35 into the ash tray 8. By actuating the grate lever 7 repeatedly, the period of time it takes for ashes to fall into the ash tray 8 may be decreased. Additionally, or alternatively, ventilation and/or air flow through the grate 5' may be increased as a result of the ashes falling into the ash tray 8.

On a front portion of stove body 1, a viewport 11 is disposed. The viewport 11 can comprise any suitable material, include heat-resisting glass. The front portion of the stove body 1 can include a vent V 23. In some embodiments, the viewport 11 and the vent V 23 can be disposed on and/or in a stove body door 10. The fire within the firebox 2 can be conveniently watched through the viewport 11. The vent V 23, as arranged, can make the burning fire spiral, and provide convenient means for using a tool to poke the ashes, making them fall from the grate 5 onto the ash tray 8. At a bottom portion of the stove body 1, legs 19 with adjustable height are installed, which can be conveniently adjusted to set a height for the stove body 1.

A vent VI 25 can be arranged at the fourth end portion of the slant tube 4.2, which can facilitate the fuels to fall into the firebox 2 from the slant tube 4.2.

Figure 4A:
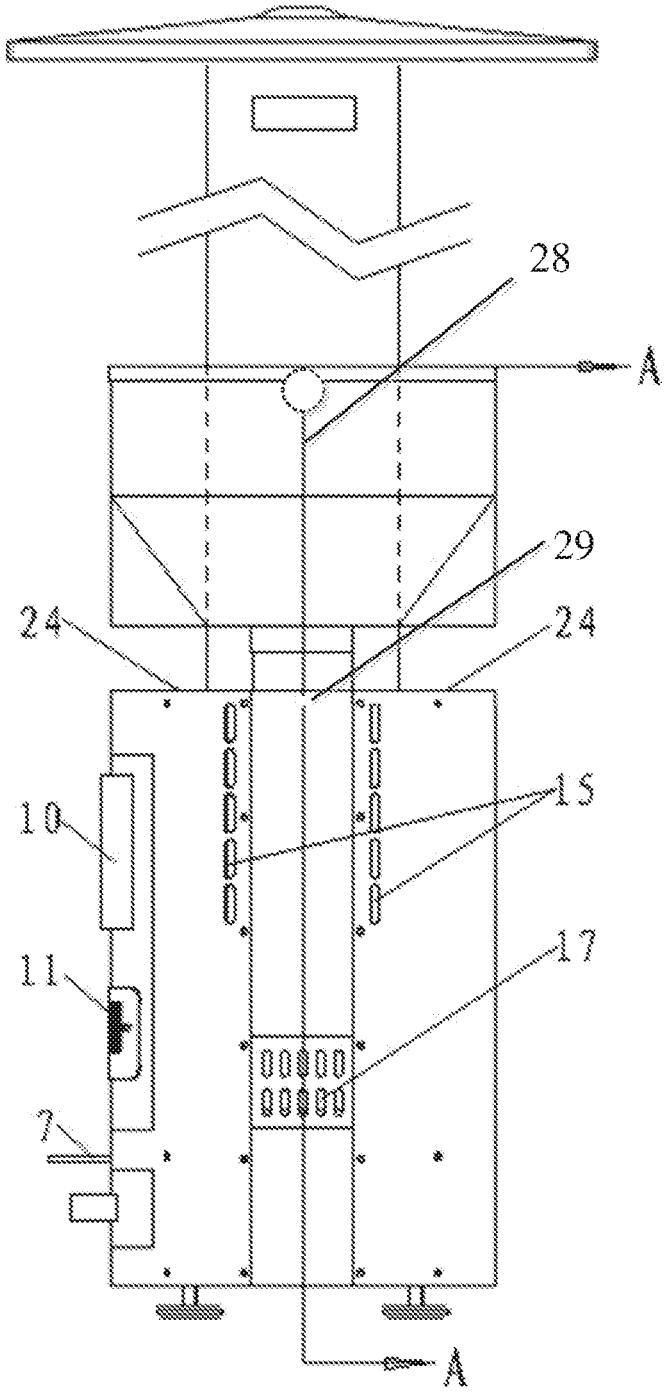
FIG. 4A generally illustrates an example biomass pellet stove with a control lever according to the principles of the present disclosure.
Figure 4B:
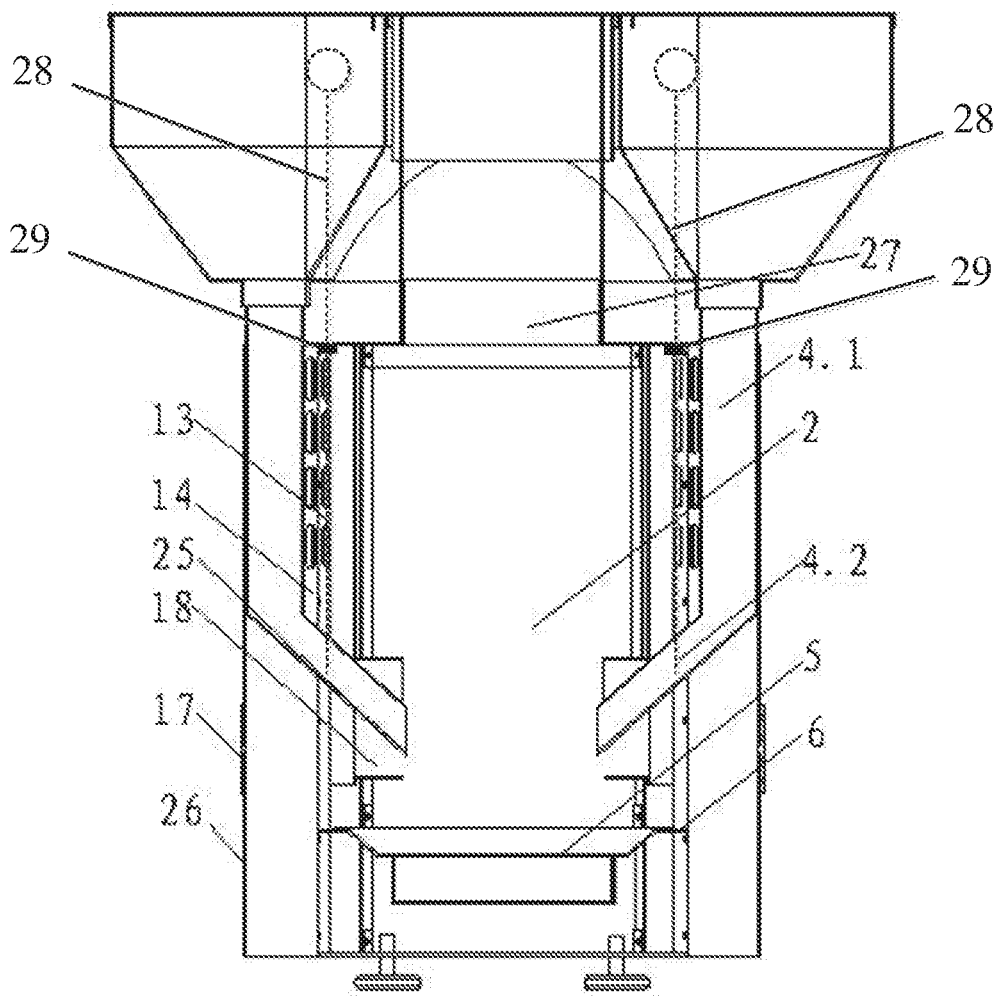
FIG. 4B generally illustrates a section A-A of the example biomass pellet stove generally illustrated in FIG. 4A.
Figure 5:
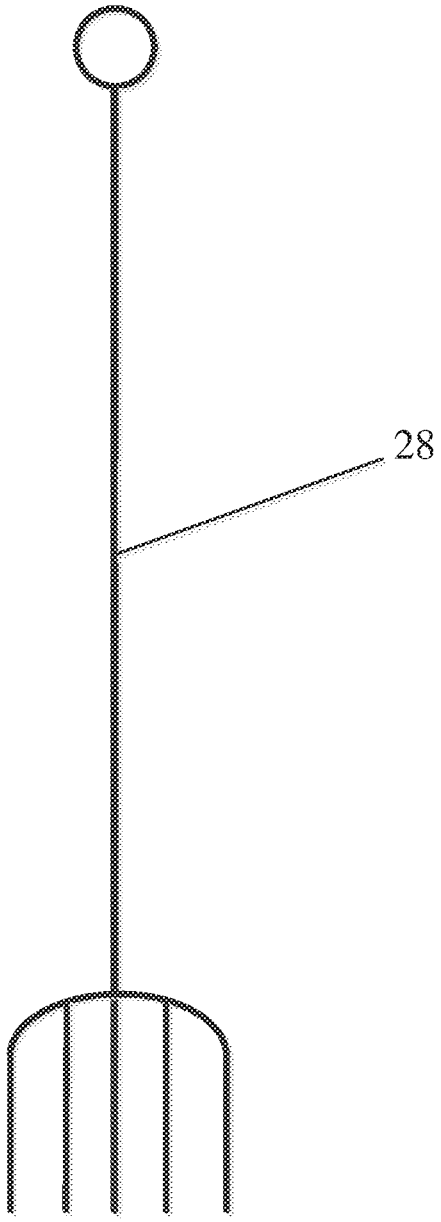
FIG. 5 generally illustrates an example control lever according to the principles of the present disclosure.

In some embodiments, for at least one of hoppers 3, the stove 100 disclosed herein can further include a control lever 28 for controlling the feeding of the pellet fuels, such as wood pellets, biomass pellets, other suitable fuels, or a combination thereof. As is generally illustrated in FIGS. 4A, 4B, and 5, the control lever 28 comprises a straight, thin shaft, with a handle (e.g., a ball-shape handle or other suitable shaped handle) disposed at a fifth end portion of the control lever 28 lever and a fork with a plurality of tines at a sixth end portion of the control lever 28. The control lever 28 can be disposed in and/or selectively inserted into the gap between the hopper 3 and the stove body 1, along an upright direction parallel or substantially parallel with the upright tube 4.1, with the ball-shaped handle at or near a top and the fork at or near a bottom. For example, the control lever 28 can be disposed within the interlayer I 13 or the interlayer II 14.

In some embodiments, the length of the shaft of the control lever 28 may be arranged so that the handle can be entirely enclosed within the hopper 3 and the hopper cover 12 when the control lever 28 is inserted into the gap between the hopper 3 and the stove body 1. The shaft of control lever 28 penetrates a ring 29 fixed on the stove body 1, through which the shaft can freely move up and down. The fork is so disposed that, when the shaft moves up and down, the fork can move respectively out of and into an intersection portion of a respective feed tube 4 along a transverse direction of the feed tube 4, in which the intersection can define holes or channels corresponding to the plurality of tines of the fork to move through. In some embodiments, the intersection portion can be around the joint of the upright tube 4.1 and the slant tube 4.2. In some implementations, the intersection portion can be a downstream position with respect to the joint. When the control lever 28 is fully pushed down by using the handle, the fork moves into the feed tube 4 and fully blocks the feed tube 4, such as acting as a gate, preventing the fuels from entering the stove body 1, by which the fire inside the firebox 2 can burn out in a relatively short time due to lack of supplemental fuels.

Figure 7A:
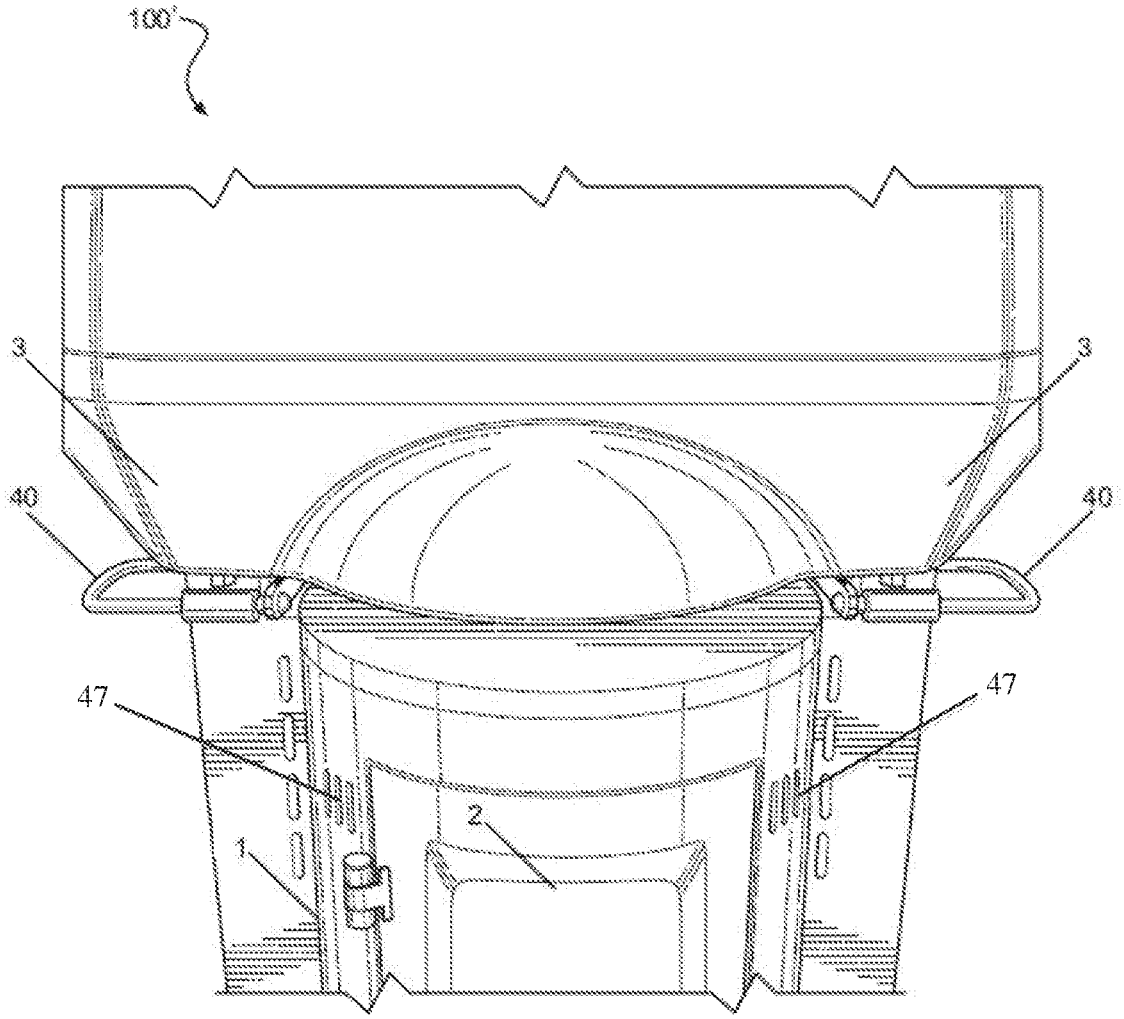
FIGS. 7A and 7B generally illustrate an example biomass pellet stove according to the principles of the present disclosure.
Figure 7B:
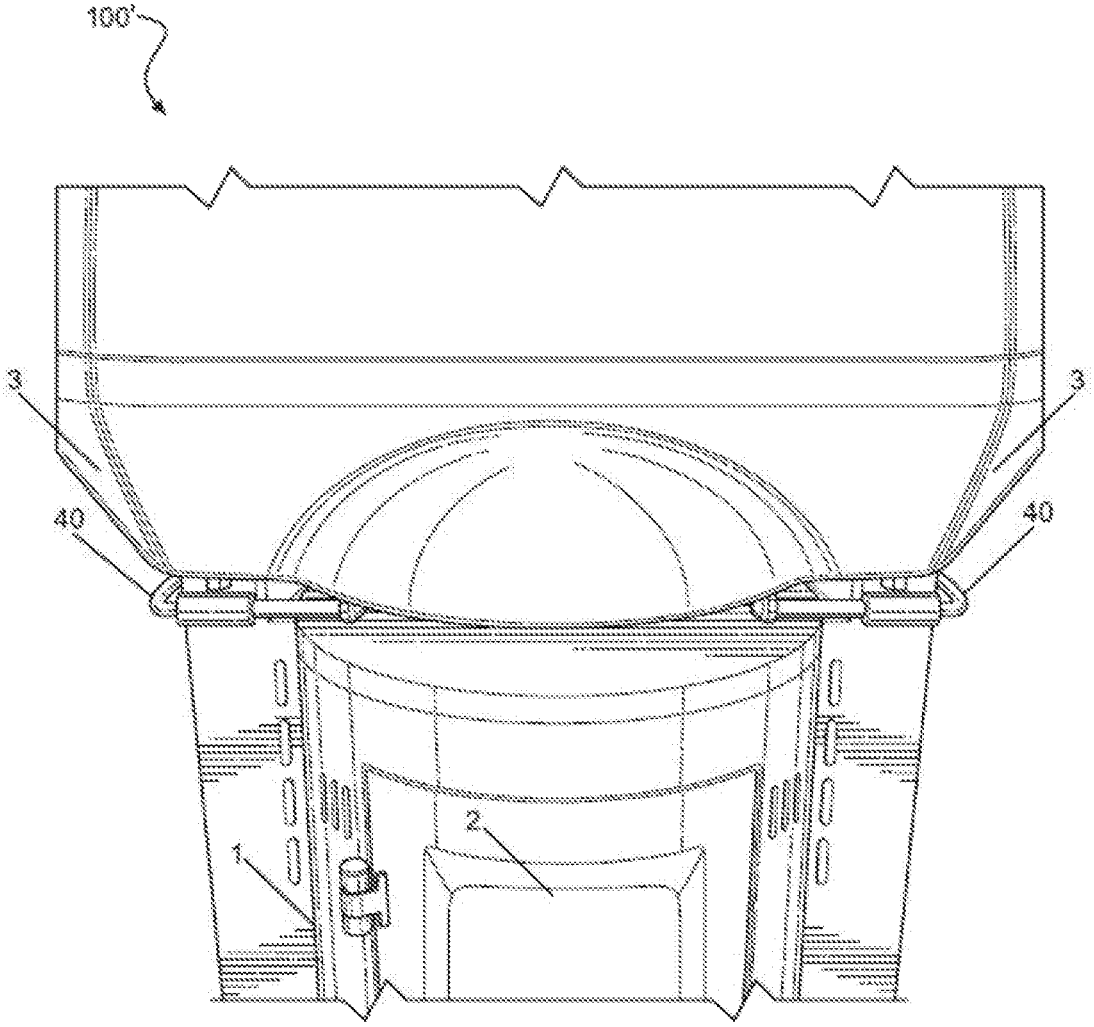

FIGS. 7A and 7B generally illustrate an example biomass pellet stove 100' according to the principles of the present disclosure. The stove 100' includes one or more control levers 40 for controlling the feeding of fuels, such as biomass pellets, from the hoppers 3 to the firebox 2. In some embodiments, the stove 100' includes two control levers 40 disposed on opposite sides of the stove 100'. Each of the control levers 40 are attached, coupled, and/or connected to a respective feed tube 4 and disposed between a respective hopper 3 and the stove body 1. For example, a first control lever 40 is attached to a first feed tube 4 disposed between a first hopper 3 and the stove body 1 and a second control lever 40 is attached to a second feed tube 4 disposed between a second hopper 3 and the stove body 1.

As is generally illustrated in FIG. 7A, each control lever 40 can be actuated to a first position. For example, each control lever 40 can be pulled out away from the stove body 1 into the first position. As is generally illustrated in FIG. 7B, each control lever 40 can be actuated to a second position. For example, each control lever 40 can be pushed in toward the stove body 1. As will be described in detail below, when a control lever 40 is in the first position, the control lever 40 restricts or prevents fuels, such as biomass pellets, within a respective hopper 3 from passing into the firebox 2 through a respective feed tube 4. Conversely, when a control lever 40 is in the second position, the control lever 40 allows fuels, such as biomass pellets, within a respective hopper 3, to pass through a respective feed tube 4 into the firebox 2.

Figure 8A:
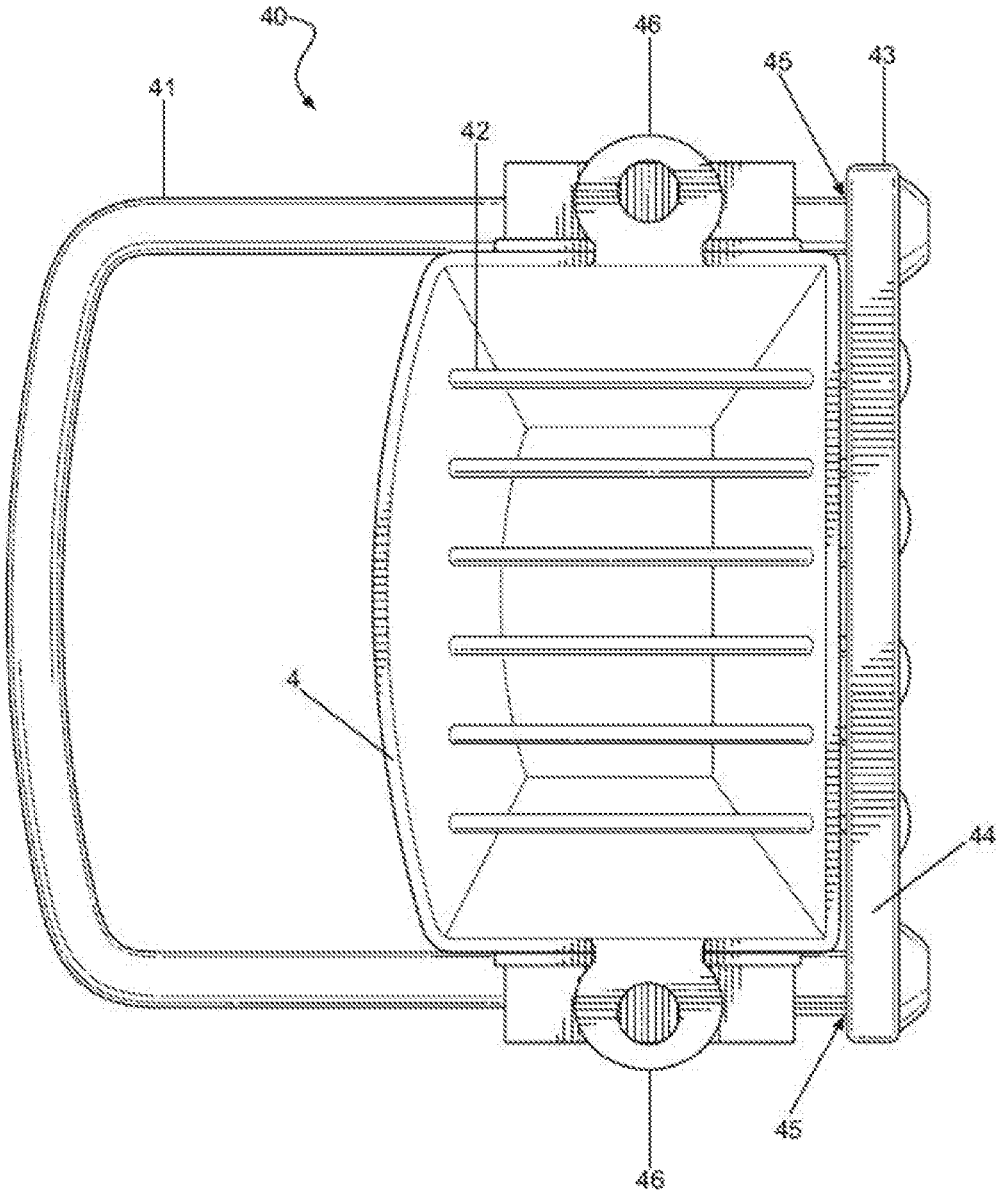
FIGS. 8A-8C generally illustrate an example control lever according to the principles of the present disclosure.
Figure 8B:
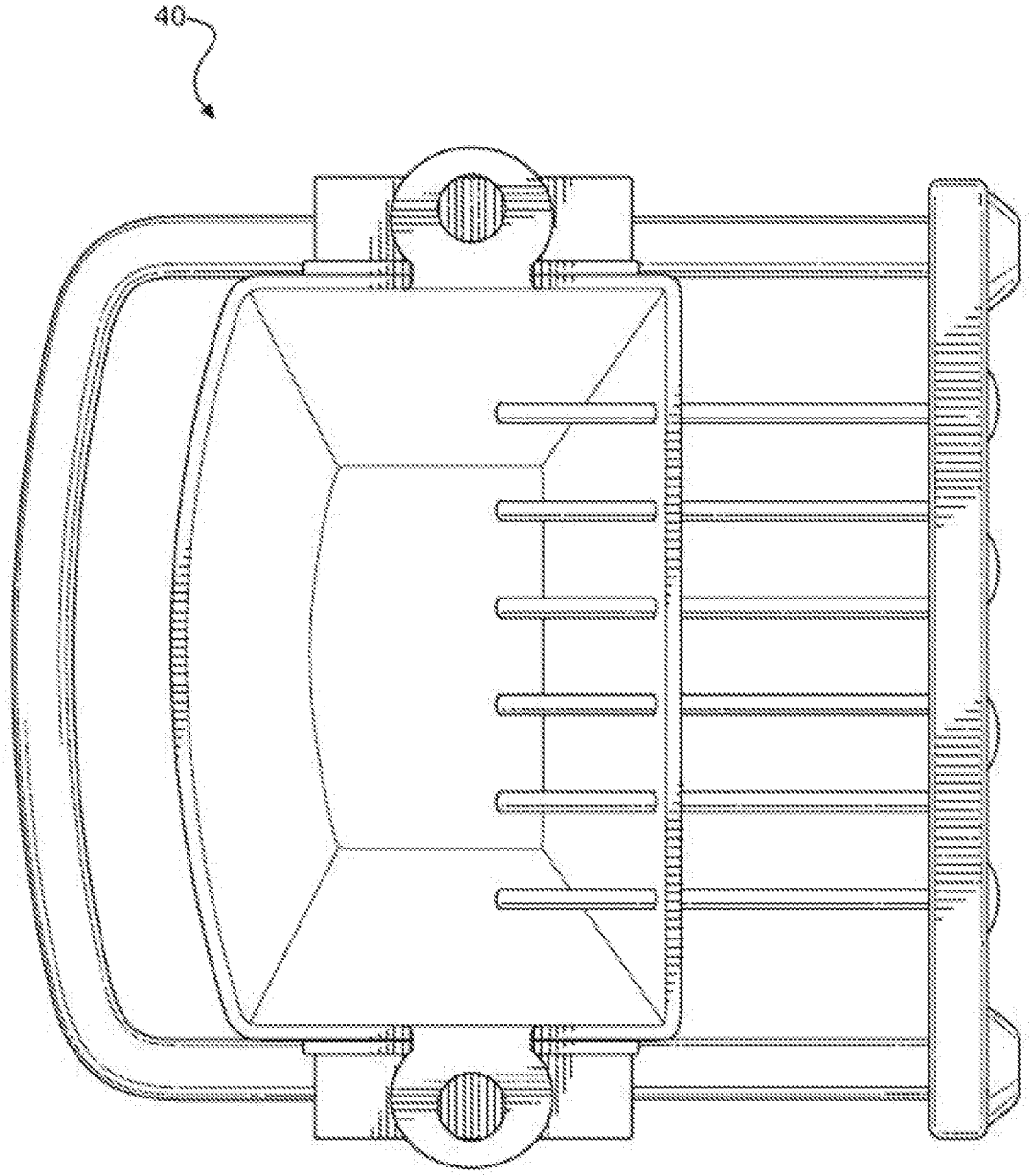
Figure 8C:
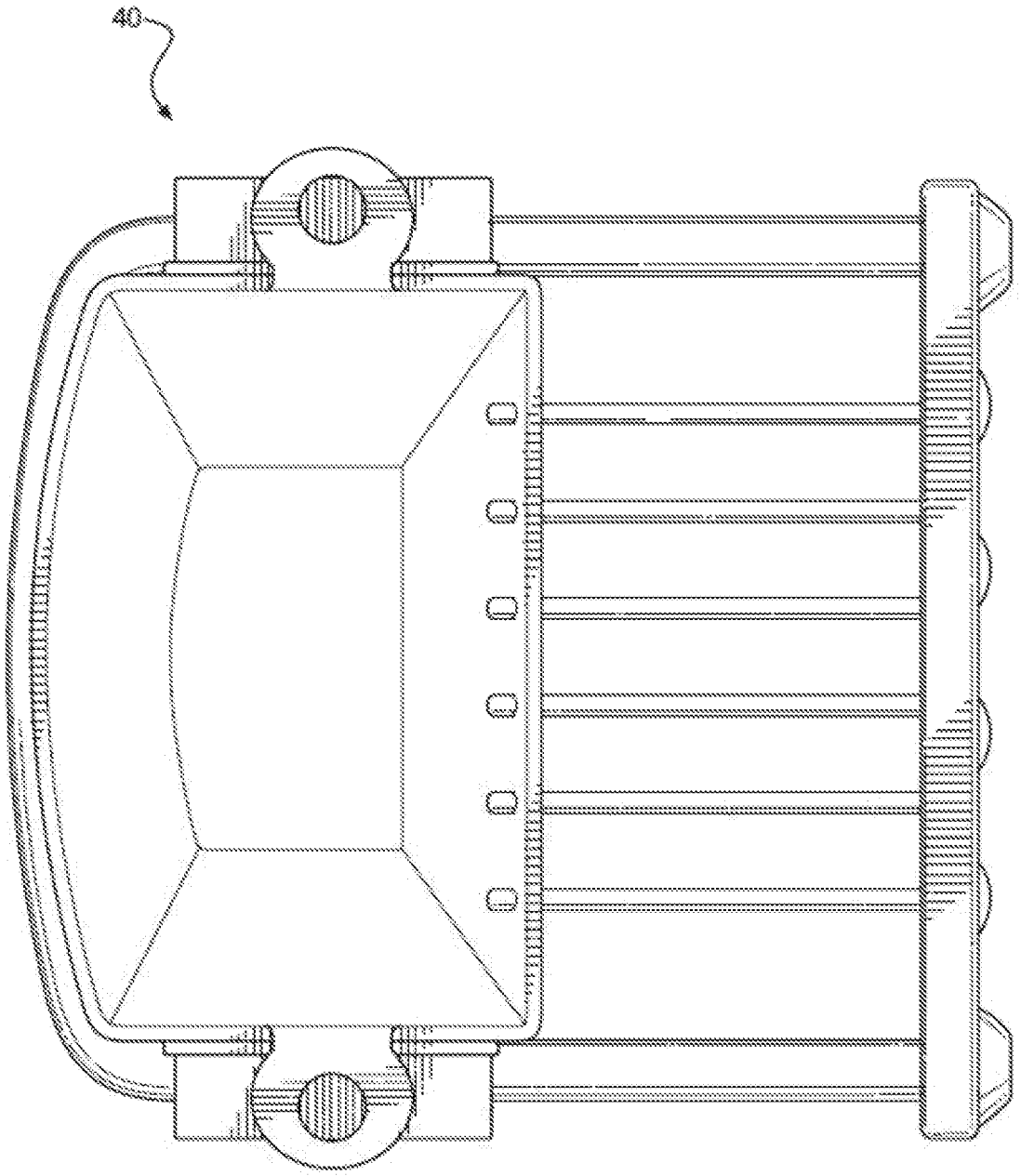

FIGS. 8A-8C generally illustrates a control lever 40 according to the principles of the present disclosure. FIG. 8A generally illustrates a control lever 40 actuated to the first position. FIG. 8B generally illustrates a control lever 40 actuated to a position between the first position and the second position. It should be understood that a control lever 40, according to the principles of the present disclosure, can be actuated to any suitable position between the first position and the second position. FIG. 8C generally illustrates a control lever 40 actuated to the second position.

In some embodiments, a control lever 40 includes a handle portion 41. The handle portion 41 may include a profile corresponding to a profile of a respective feed tube 4, or may include any suitable profile and/or shape. The handle portion 41 provides a means for lifting and/or moving the stove 100. For example, when a control lever 40 is in the first position, a respective handle portion 41 may extend away from a respective feed tubes 4. The handle portion 41 extends beyond a respective hopper 3 when the control lever 40 is in the first position.

The handle portion 41 may be gripped by a user of the stove 100. The user may lift and/or move the stove 100 while gripping the handle portion 41. When a control lever 40 is in the second position, a respective handle portion 41 is pushed in toward the stove body 1, such that, the handle portion 41 does not extend beyond a respective hopper 3. In some embodiments, the handle portion 41 may be hidden when the control lever 40 is in the second position.

Each of the control levers 40 includes a shutoff gate or fork 42. A fork 42 includes a plurality of tines that extends from a first side 43 of a respective control lever 40 toward a respective handle portion 41. The first side 43 is disposed opposite the handle portion 41. The tines may be disposed on the first side 43, such that, fuels, such as biomass pellets, are restricted and/or prohibited from passing beyond the fork 42 into a respective feed tube 4.

For example, a fork 42 is disposed, such that, the fork 42 can move respectively out of and into an intersection portion of a respective feed tube 4 along a lateral direction of the feed tube 4, in which the intersection can define holes or channels corresponding to the plurality of tines of the fork 42 to move through. In some embodiments, the intersection portion can be through a portion of a respective feed tube 4 disposed between a respective hopper 3 and the baking area 24. When the control lever 28 is the first position, the fork 42 moves into the feed tube 4 and blocks or substantially blocks the feed tube 4, such as acting as a gate, preventing the fuels, such as biomass pellets, from entering the firebox 2, by which the fire inside the firebox 2 can burn out in a relatively short time due to lack of supplemental fuels.

Conversely, when a control lever 40 is in the second position, a respective fork 42 is pushed in toward the stove body 1, such that, the plurality of tines does not extend into a respective feed tube 4, thereby allowing fuels, such as biomass pellets, within a respective hopper 3 to pass into a respective feed tube 4 into the firebox 2. In some embodiments, the control lever 40 may be selectively positioned in any suitable position between the first and second position. The plurality of tines of a respective fork 42 of a control lever 40 in a position between the first and second positions may partially extend into the respective feed tube 4, thereby partially blocking fuels, such as biomass pellets, from passing into the feed tube 4 and the firebox 2.

In some embodiments, each control lever 40 includes a stop 44 disposed at or near the first side 43. The stop 44 prevents a respective fork 42 from extending beyond a respective feed tube 4 when a respective control lever 40 is actuated into the first position. Additionally, or alternatively, a respective handle portion 41 may be secured to the control lever 40 via the stop 44. For example, end portions 45 of a handle portion 41 may be welded to the stop 44, screwed to the stop 44, connected to the stop 44 using other suitable techniques, or a combination thereof. In some embodiments, the control lever 40 comprises a unitary member that includes a handle portion 41, a fork 42, and a stop 44. In some embodiments, a control lever 40 may be secured to a respective feed tube 4 by one or more brackets 46. The brackets 46 include a cylindrical profile and may be secured to the feed tube 4 using a suitable technique, such as welding. The brackets 46 are configured such that the control lever 40 can freely move between the first and second positions.

In some embodiments, stove 100' includes one or more secondary combustion air inlets 47. As is generally illustrated in FIG. 7A, the stove 100' may include a secondary combustion air inlet 47 disposed on a front side of the stove body 1 on opposed sides of the firebox 2. Additionally, or alternatively, the stove 100' may include one or more secondary combustion air inlets 47 disposed on a rear side of the stove body 1 that is on an opposite side of the stove body 1 from the front side. In some embodiments, the stove 100' may include four secondary combustion air inlets 47.

Each of the secondary combustion air inlets 47 promote a secondary combustion of fuels within the firebox 2. For example, when fuels, such as biomass pellets, within the firebox 2 are ignited or combusted, some of the fuels may not properly combust or may inefficiently combust due to a lack of oxygen. Inefficiently combusted fuels may result in carbon particles rising up through the firebox 2. The secondary combustion air inlets 47 provide additional oxygen and/or air flow into the firebox 2 thereby promoting a secondary combustion of the carbon particles. The carbon particles are then consumed by the combustion which may result in little or no smoke exiting the firebox 2.

Figure 9A:
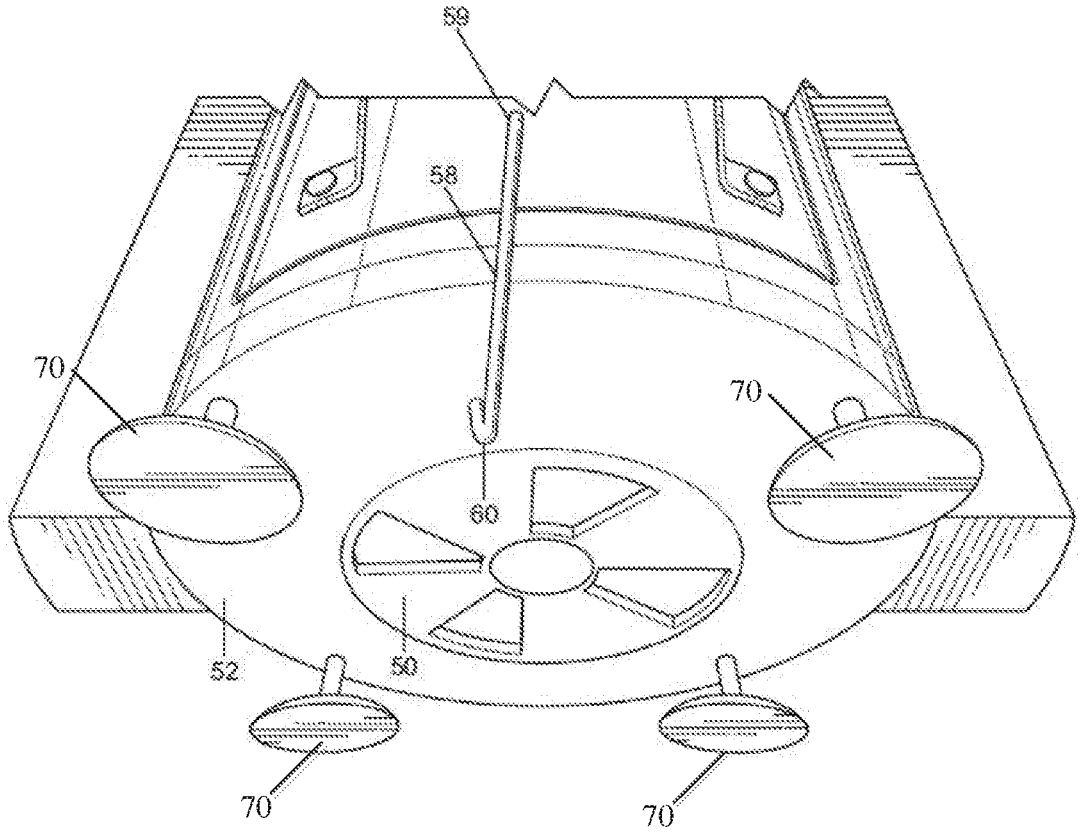
FIGS. 9A-9C generally illustrate an example of an air intake damper according to the principles of the present disclosure.
Figure 9B:
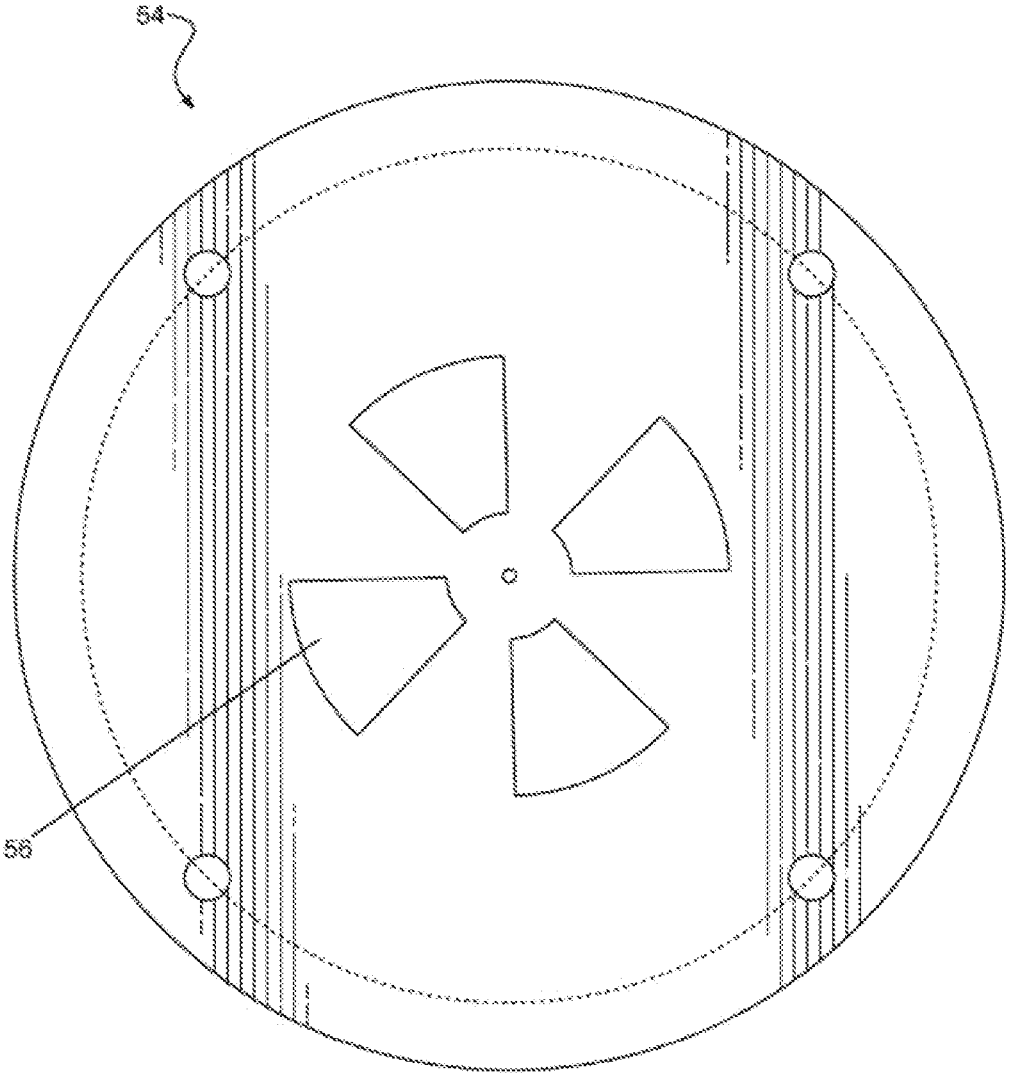
Figure 9C:
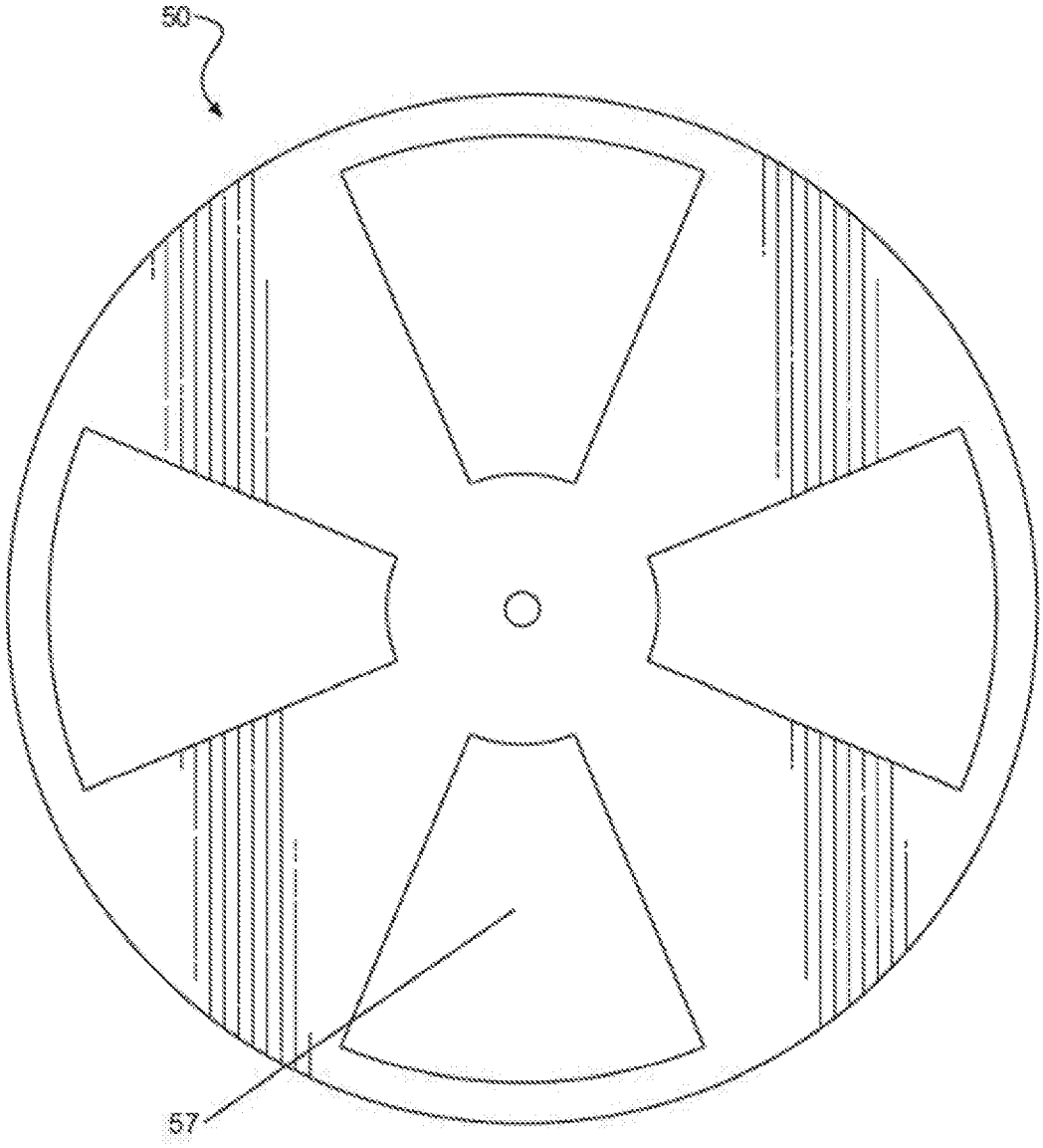

FIGS. 9A-9C generally illustrate an example air intake damper 50 according to the principles of the present disclosure. In some embodiments, the air intake damper 50 is disposed on a bottom surface 52 of the stove body 1. The bottom surface 52 includes an air intake 54, as is generally illustrated in FIG. 9B. The air intake 54 includes a plurality of air intake apertures 56. The air intake apertures 56 may be disposed evenly or unevenly on a surface of the air intake 54. The air intake apertures 56 allow air to be draw from outside of the firebox 2 into the firebox 2. Air drawn into the firebox 2 may promote combustion of the fuels, such as biomass pellets, within the firebox 2.

In some embodiments, the air intake damper 50 is secured to the bottom surface 52 such that the air intake damper 50 covers the air intake 54. The air intake damper 50 may be secured to the bottom surface 52 using any suitable technique. In some embodiments, the air intake damper 50 is rotatably secured to the bottom surface 52 at or near a center of the air intake 54. For example, the air intake damper 50 may be screwed, riveted, or otherwise secured to the center of the air intake 54. The air intake damper 50 is rotatably adjustable about the center of the air intake 54. For example, the air intake damper 50 may be riveted to the air intake 54. The air intake damper 50 may rotate about the rivet securing the air intake damper 50 to the air intake 54.

In some embodiments, the air intake damper 50 includes a plurality of air control apertures 57, as is generally illustrated in FIG. 9C. The air control apertures 57 may be disposed evenly or unevenly on a surface of the air intake damper 50. The air control apertures 57 include a profile corresponding to a profile of the air intake apertures 56. In some embodiments, the air control apertures 57 are disposed on the surface of the air intake damper 50 such that, when the air intake damper 50 is rotated to a first position, none of the air control apertures 57 overlap the air intake apertures 56. When the air intake damper 50 is in the first position, air is restricted and/or prohibited from being drawn into the firebox 2. This may reduce or extinguish the fire within the firebox 2 (e.g., due to a lack of oxygen required to continue combustion of the fuels within the firebox 2).

When the air intake damper 50 is rotated to a second position, each of the air control apertures 57 overlaps or substantially overlaps a corresponding air intake aperture 56. This may increase flame size associated with the fire within the firebox 2 (e.g., as a result of an increase in oxygen within the firebox 2). When the air intake damper 50 is rotated to a position between the first and second positions, each of the air control apertures 57 partially overlaps a corresponding air intake aperture 56. The fire within the firebox 2 may be increased or reduced in response to the air intake damper 50 between rotated to a position between the first and second position (e.g., as the air intake damper 50 is rotated closer to the first position, the fire within the firebox 2 will be reduced, when the air intake damper 50 is rotated closer to the second position, the fire within the firebox 2 will be increased).

In some embodiments, the air intake damper 50 includes an air adjustment rod or control arm 58. The control arm 58 extends in a lateral direction away from the stove body 1. The control arm 58 includes a handle 59 and a connecting portion 60. The connecting portion 60 is disposed at a first end of the control arm 58 and may be connected to a portion of the air intake damper 50 using conventional techniques. For example, the connecting portion 60 may be welding to a surface of the air intake damper 50. The handle 59 is disposed at a second end opposite the connecting portion 60 and may comprise a flat profile disposed at a first end of the control arm 58. The handle 59 may comprise any suitable shape and/or profile other than those described herein. A user may grip the handle 59 and selectively rotate the air intake damper 50, as described above.

Figure 10:
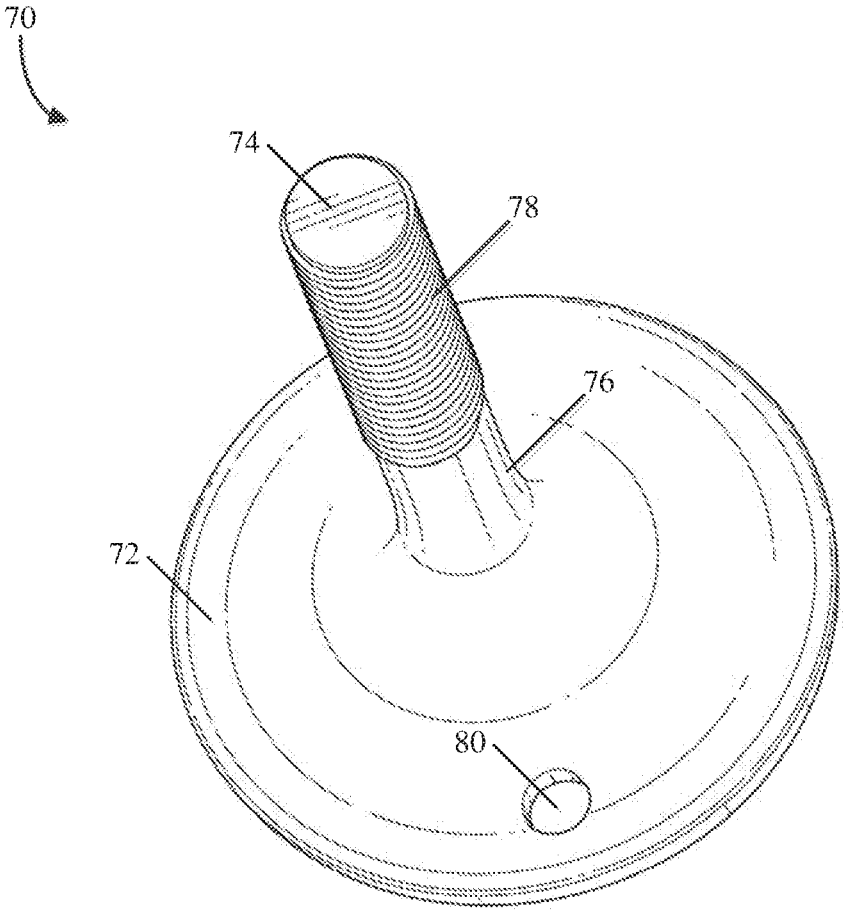
FIG. 10 generally illustrates an example stove foot according to the principles of the present disclosure.

FIG. 10 generally illustrates an example stove foot 70 according to the principles of the present disclosure. As is generally illustrated in FIG. 9A, the stove 100' includes a plurality of feet 70 disposed on a bottom surface 52. In some embodiments, the stove 100' includes 4 feet 70 disposed equidistant from each other on the bottom surface 52. The feet 70 are configured to lift the bottom surface 52 off of a surface (e.g., the ground) below the stove 100'. This may promote airflow into the damper 50. As is generally illustrated in FIG. 10, the foot 70 includes a base 72 and a mounting shaft 74 extending away from the base. The mounting shaft includes a first portion 76 and a second portion 78. The first portion 76 may be disposed proximate the base 72 and include a profile that is wider than a profile of the second portion 78. The profile of the first portion 76 smoothly transitions into the profile of the second portion 78. For example, the profile of the first portion 76 may include a generally conical profile and may transition into the profile of the second portion 78 which may include a generally cylindrical profile.

The second portion 78 is dosed distally with respect to the base 72 and includes a plurality of threads. The plurality of threads is adapted to secure the foot 70 to the bottom surface 52. In some embodiments, the foot 70 includes a securing aperture 80. The securing aperture 80 may be disposed on the base 72. The securing aperture 80 may be adapted to receive a securing mechanism, such as a stake, post, or other suitable mechanism for securing the foot 70 to a surface below the stove 100'. For example, each of the feet 70 (as is generally illustrated in FIG. 9A) may be contacting a surface below the stove 100'. A first end of a stake may be inserted into corresponding ones of the securing apertures 80 and a second end of the stake may wrap around an edge of the base 72 proximate the securing aperture 80. This may reduce the risk that the stove 100' may be tipped over.

All references, including publications, patent applications, and patents, cited herein are hereby incorporated by reference to the same extent as if each reference were individually and specifically indicated as incorporated by reference and were set forth in its entirety herein.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A stove, using biomass pellets as fuels, comprising:

a stove body that includes a firebox;

a grate disposed in the firebox, the grate comprising a planar plate having a first planar face and a second planar face, the second planar face opposed to the first planar face;

at least one hopper, the at least one hopper having an inner cavity, the inner cavity configured to removably contain the biomass pellets; and at least one feed tube, the at least one feed tube having a first end and a second end opposed to the first end, the at least one feed tube extending between the at least one hopper and the firebox, wherein the first end of the at least one feed tube communicates with the inner cavity of the at least one hopper and the second end of the at least one feed tube is located proximate to the grate; and at least one control lever laterally disposed on the at least one feed tube, the at least one control lever moveable between a first position and a second position;

wherein biomass pellets as fuels within the at least one hopper enter the firebox along the at least one feed tube under gravity when the at least one control lever is in a second position and, wherein the grate further comprises at least one first wall member, the first wall member connected to the first planar face of the plate at a perimeter region thereof and extending outward from the first planar face, the first wall member having at least one wall aperture defined therein; wherein the grate further comprises at least one second wall member, the second wall member connected to the first planar face of the plate at the perimeter region thereof and extending outward from the first planar face, the at least one second wall member contiguous to the at least one first wall member and oriented perpendicular thereto, the second wall member defining a solid member and wherein the at least second one wall member is located proximate to the second end of the at least one feed tube.

2. The stove of claim 1, further comprising two hoppers, wherein the two hoppers are disposed on opposite sides of the stove and wherein the at least one feed tube extends between each of the two hoppers to the firebox.

3. The stove of claim 2, wherein a cross section of the firebox is circular and the two hoppers are symmetrically arranged with respect to a centerline of the firebox.

4. The stove of claim 1, further comprising two control levers disposed on opposite sides of the stove.

5. The stove of claim 1, wherein the at least one control lever comprises a fork having a plurality of tines extending from a first side of the at least one control lever; and a handle portion connected to the fork, the handle movably projecting through the at least one hopper to facilitate movement of the at least one control lever from the first position to the second position, wherein the fork laterally intersects the at least one feed tube and blocks the fuel pellets from entering the firebox from the at least one hopper when the at least one control lever is in the first position.

6. The stove of claim 5, the grate further comprising a shaker disposed parallelly to the plate, the shaker having a planar body including a first face and a opposed second face and a plurality of shaker apertures extending from the first face to the second face, wherein the shaker is further moveable relative to the plate from at least one first position to at least one second position, wherein at least a portion of the plate apertures align with at least a portion of the shaker apertures when the shaker is in a first position, wherein ashes on the grate pass through the plurality of plate apertures and through the plurality of shaker apertures when the shaker is actuated between the at least one first position and the at least one second position;

wherein the planar plate of the grate includes a plurality of plate apertures defined in the plate, the plurality of plate apertures extending from the first planar face to the second planar face.

7. The stove of claim 6, wherein the plurality of plate apertures defined in the plate comprise central plate apertures and perimeter plate apertures, wherein at least one perimeter plate aperture corresponds to the wall aperture defined in the first wall member.

8. The stove of claim 1, wherein a hopper cover is on a top portion of the at least one hopper.

9. The stove of claim 1, wherein the first and second wall members are contiguously joined to one another and define a rectilinear frame extending along a perimeter of the plate of the grate, wherein biomass pellets as fuels enter the firebox along the at least one feed tube onto the grate.

10. The stove of claim 1, further comprising an air intake damper rotatably secured to an air intake disposed on a bottom surface of the stove, wherein the air intake damper includes a control arm that rotates the air intake damper.

11. A stove, using biomass pellets as fuels, comprising:

a stove body that includes a firebox;

a grate disposed in the firebox, the grate comprising a planar plate having a first planar face and a second planar face, the second planar face opposed to the first planar face;

a first hopper disposed on a first side of the stove and a second hopper disposed on a second side of the stove, wherein the first and second hoppers each have an inner cavity, their respective inner cavities configured to removably contain the biomass pellets; and a first feed tube firebox and a second feed tube, wherein the first and second feed tubes each have a first end and a second end, the second ends each opposed to their respective first ends, the first feed tube and the second feed tube each extending between the respective first or second hopper and the firebox, wherein the first end of each feed tube communicates with the inner cavity of the respective hopper and the second ends of the respective feed tubes are opposed to one another and are located proximate to the grate; and a first control lever laterally disposed on the first feed tube, the first control lever moveable between a first position and a second position relative to the first feed tube and a second control lever laterally disposed on the second feed tube, the second control lever moveable between a first position and a second position relative to the second feed tube;

wherein biomass pellets as fuels within the first hopper enter the firebox along the first feed tube under gravity when the first control lever is in the second position and wherein biomass pellets as fuels within the second hopper enter the firebox along the second feed tube under gravity when the second control lever is in the second position, wherein the first control lever is located in a gap provided between the first hopper and the stove body, and the second control lever is located in a gap provided between the second hopper and the stove body; and wherein the grate further comprises at least one first wall member, the first wall member connected to the first planar face of the plate at a perimeter region thereof and extending outward from the first planar face, the first wall member having at least one wall aperture defined therein; wherein the grate further comprises at least one second wall member, the second wall member connected to the first planar face of the plate at the perimeter region thereof and extending outward from the first planar face, the at least one second wall member contiguous to the at least one first wall member and oriented perpendicular thereto, the second wall member defining a solid member and wherein the at least second one wall member is located proximate to the second end of the at least one feed tube.

12. The stove of claim 11, wherein the first control lever includes a first fork having a first plurality of tines extending from a first side of the first control lever and the second control lever includes a second fork having a second plurality of tines extending from a first side of the second control lever.

13. The stove of claim 12, wherein the first fork laterally intersects the first feed tube and blocks biomass pellets as fuels from entering the firebox from the first hopper when the first control lever is in the first position and wherein the second fork laterally intersects the second feed tube and blocks biomass pellets as fuels from entering the firebox from the first hopper when the second control lever is in the first position.

14. The stove of claim 11, wherein the first control lever includes a first handle portion that extends beyond the first hopper when the first control lever is in the first position and wherein the second control lever includes a second handle portion that extends beyond the second hopper when the second control lever is in the first position.

15. The stove of claim 11, wherein the first and second control levers are symmetrically disposed relative to the firebox and the first and second control levers each further comprise lifting handles.

16. The stove of claim 15, wherein the grate further comprises a shaker, the shaker having a plurality of shaker apertures staggered relative to a plurality of plate apertures disposed on the plate.

17. The stove of claim 16, wherein ashes on the grate pass through the plurality of plate apertures and through the plurality of shaker apertures when the shaker is actuated between the first position and the second position.

18. The stove of claim 11, further comprising an air intake damper rotatably secured to an air intake disposed on a bottom surface of the stove, wherein the air intake damper includes a control arm that rotates the air intake damper.

* * * * *